US008047974B1

(12) United States Patent
Kanelos

(10) Patent No.: US 8,047,974 B1
(45) Date of Patent: Nov. 1, 2011

(54) EXERCISE APPARATUS AND METHODS OF ASSEMBLING AND USING THE SAME

(76) Inventor: Stephen A. Kanelos, Bullhead City, AZ (US)

( * ) Notice: Subject to any disclaimer, the term of this patent is extended or adjusted under 35 U.S.C. 154(b) by 0 days.

(21) Appl. No.: 12/849,586

(22) Filed: Aug. 3, 2010

(51) Int. Cl.
*A63B 21/072* (2006.01)

(52) U.S. Cl. ..... 482/106; 482/107; 482/910

(58) Field of Classification Search ..... 482/38, 482/92–96, 106–109, 126, 908, 910; D21/679–682
See application file for complete search history.

(56) References Cited

U.S. PATENT DOCUMENTS

| | | | | |
|---|---|---|---|---|
| 1,536,048 | A * | 5/1925 | Alastalo | 482/108 |
| 2,470,815 | A * | 5/1949 | Harvey | 482/106 |
| 3,942,790 | A * | 3/1976 | Rice | 482/91 |
| 4,618,142 | A * | 10/1986 | Joseph, Jr. | 482/82 |
| 4,682,774 | A * | 7/1987 | Holy | 463/47.5 |
| 4,690,400 | A * | 9/1987 | Metz | 482/106 |
| 4,722,523 | A | 2/1988 | Yang | |
| 5,152,731 | A * | 10/1992 | Troutman | 482/106 |
| 5,244,445 | A | 9/1993 | Amesquita | |
| 5,312,314 | A | 5/1994 | Stephan | |
| 5,328,431 | A | 7/1994 | Winslow | |
| 5,346,449 | A * | 9/1994 | Schlagel | 482/107 |
| 5,441,471 | A | 8/1995 | Passer | |
| 5,653,664 | A | 8/1997 | Jennings | |
| 5,669,529 | A | 9/1997 | Levit | |
| 5,776,083 | A | 7/1998 | Jacob et al. | |
| 5,803,876 | A * | 9/1998 | Hickman | 482/72 |
| 6,059,700 | A | 5/2000 | Ellenburg | |
| 6,196,921 | B1 * | 3/2001 | Larson | 463/47.2 |
| 6,224,520 | B1 | 5/2001 | Hsu | |
| 6,379,286 | B1 | 4/2002 | Scopino et al. | |
| 6,592,499 | B2 * | 7/2003 | Parker | 482/106 |
| 6,602,169 | B1 | 8/2003 | Patti | |
| 7,001,315 | B1 * | 2/2006 | Diodati | 482/121 |
| 7,086,999 | B2 * | 8/2006 | Jeneve et al. | 482/106 |
| 7,090,627 | B1 | 8/2006 | Walker | |
| 7,364,536 | B2 | 4/2008 | Cappellini | |
| 7,465,258 | B1 | 12/2008 | Mortorano | |
| 7,465,259 | B2 | 12/2008 | Mok | |
| 2004/0063554 | A1 * | 4/2004 | Wince | 482/108 |
| 2004/0185990 | A1 | 9/2004 | Orescan et al. | |
| 2007/0117688 | A1 * | 5/2007 | Sewitch et al. | 482/83 |
| 2008/0096737 | A1 | 4/2008 | Ayoub | |
| 2008/0223677 | A1 * | 9/2008 | Mauro | 190/111 |
| 2008/0280738 | A1 | 11/2008 | Brennan et al. | |
| 2009/0058872 | A1 * | 3/2009 | Boettcher et al. | 345/589 |
| 2009/0192027 | A1 * | 7/2009 | Parker | 482/108 |
| 2009/0239719 | A1 | 9/2009 | Patti | |
| 2010/0016130 | A1 | 1/2010 | Schiff | |
| 2010/0029447 | A1 * | 2/2010 | Song | 482/93 |

* cited by examiner

*Primary Examiner* — Loan Thanh
*Assistant Examiner* — Daniel Roland

(57) ABSTRACT

An exercise apparatus includes a bar assembly and weight assemblies and can be used according to various methods of performing exercise routines using the apparatus. An exemplary exercise apparatus includes bar segments that are coupled together to create a bar assembly. Weight can be added to the bar assembly and the assembled device can be used to perform exercises that involve, for example, twisting and stretching.

11 Claims, 15 Drawing Sheets

EXERCISE APPARATUS AND METHODS OF ASSEMBLING AND USING THE SAME

BACKGROUND

Traditionally, getting in shape has come at the expense of physical discomfort experienced during the process. Additionally, conventional exercise equipment is too big and/or heavy to be transported easily and can occupy unnecessarily large amounts of space. Moreover, traditional exercise equipment and methods of using them tend to focus on low-impact stretching, cardiovascular exercise, or light weight-lifting exercise, but not all three.

SUMMARY

This summary is provided to introduce a selection of concepts in a simplified form that are further described below in the Detailed Description. This summary is not intended to identify key features or essential features of the claimed subject matter, nor is it intended to be used, in isolation, as an aid in determining the scope of the claimed subject matter. At a high level, embodiments of the invention relate to an exercise apparatus and methods of using the apparatus that facilitates a combination of low-impact stretching, cardiovascular exercise, and light weight-lifting exercise that can enable users to improve physical well-being without the physical discomfort that exercise often entails. Embodiments of the invention relate to an exercise apparatus that is flexible and accommodating, can be broken down and reassembled quickly, and that facilitates adaptable exercises that can be performed in relatively small spaces.

A first illustrative embodiment of the present invention relates to an apparatus for performing exercises. In embodiments, the apparatus includes a bar assembly and one or more weight assemblies. In embodiments, the weight assemblies can be removably coupled to the bar assembly. In some embodiments, the bar assembly includes one or more bar segments joined by couplings and one or more end segments that receive, or include, the weight assemblies.

A second illustrative embodiment of the present invention relates to a method of assembling an exercise apparatus. Embodiments of the illustrative method include removing the component parts from a container, assembling the bar assembly by coupling bar segments, and adding weight assemblies to the bar assembly. A third illustrative embodiment of the present invention relates to a method of using an exercise apparatus to perform an exercise routine. Additional embodiments of the invention include exercise programs specifying workouts and routines.

These and other aspects of the invention will become apparent to one of ordinary skill in the art upon a reading of the following description, drawings, and the claims.

BRIEF DESCRIPTION OF THE DRAWINGS

The present invention is described in detail below with reference to the attached drawing figures, wherein.

DETAILED DESCRIPTION

The subject matter of embodiments of the invention disclosed herein is described with specificity to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the term "step" is used herein to connote different elements of methods employed, the term should not be interpreted as implying any particular order among or between various steps herein disclosed unless and except when the order of individual steps is explicitly described.

Figure 1A:
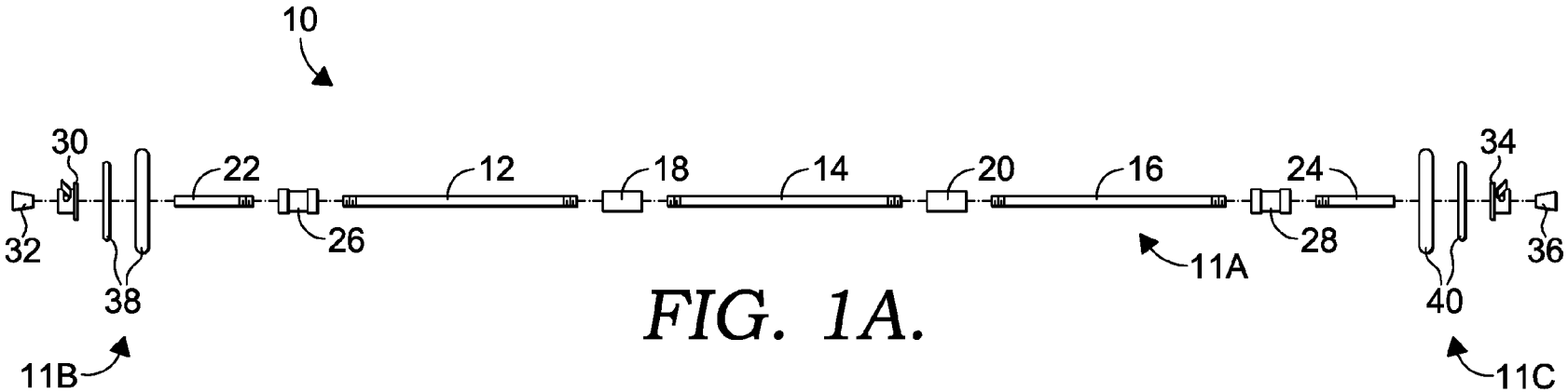
FIG. 1A is an exploded top view of an exercise apparatus in accordance with embodiments of the invention.
Figure 1B:
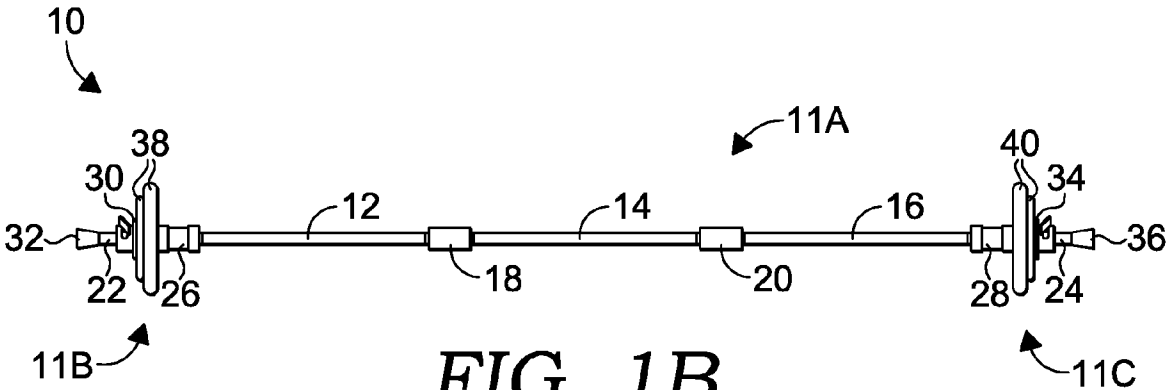
FIG. 1B is a top view of an exercise apparatus in accordance with embodiments of the invention.
Figure 1C:
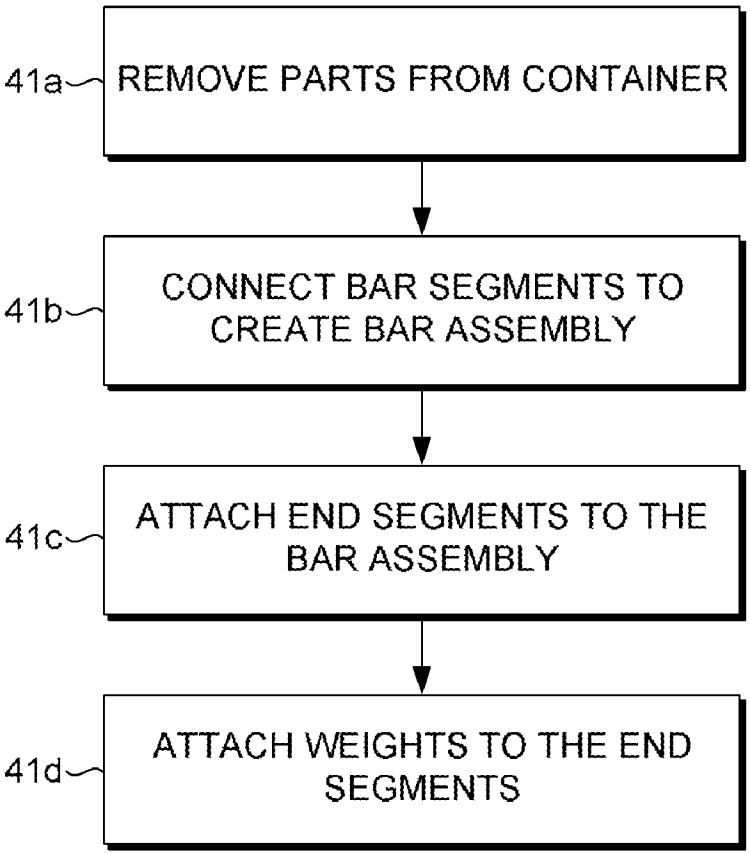
FIG. 1C is a flow diagram depicting an illustrative method of assembling an exercise apparatus in accordance with embodiments of the invention.

Referring to the drawings, and particularly to FIGS. 1A-1C, there is depicted an illustrative exercise apparatus 10. Illustrative exercise apparatus 10 can be, for example, purchased as part of a portable exercise system that includes parts

Figure 1D:
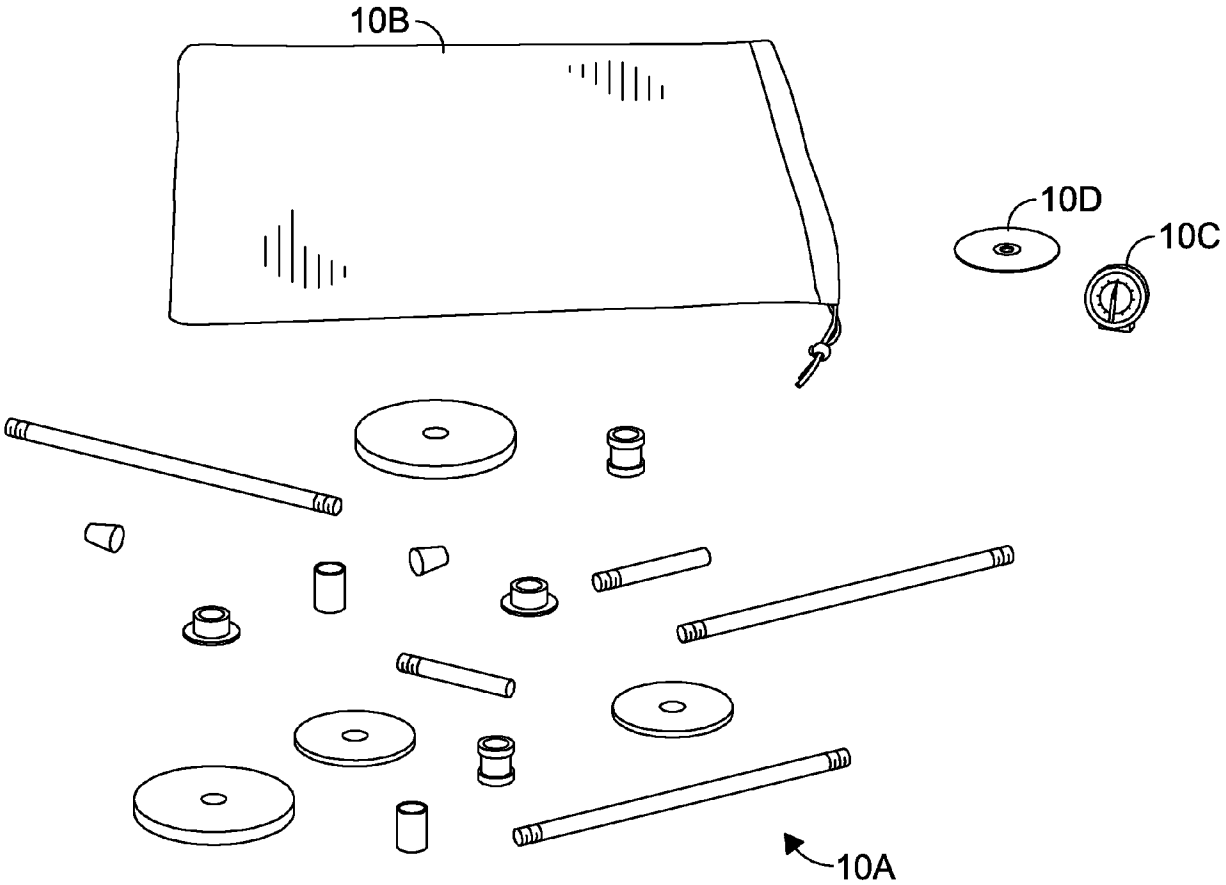
FIG. 1D depicts a portable exercise system in accordance with embodiments of the invention.

10*a* as shown in FIGS. 1A and 1D and that can be assembled, as shown in FIG. 1B, to create an exercise apparatus 10. According to embodiments of the invention, exercise apparatus 10 includes a bar assembly 11*a*, to which weight assemblies 11*b* and 11*c* can be removably attached. In some embodiments, as illustrated in FIG. 1D, the set 10*a* of parts can be provided with a container 10*b* such as, for example, a cloth or plastic bag for storing and transporting the set 10*a* of parts of the apparatus, a timing device 10*c* (e.g., a large-faced, battery powered timer), a recording medium 10*d* having a recording embodied thereon (e.g., a compact disc (CD) having music embodied thereon, a digital versatile disc (DVD) having a video embodied thereon, etc.) and the like.

As illustrated in FIGS. 1A and 1B, bar assembly 11*a* includes bar segments 12, 14, and 16 that can be coupled in series by a pair of couplers 18 and 20 to make a straight bar structure. As depicted, a first bar segment 12 is removably connected to a second bar segment 14 by disposing a coupler 18 between an end of bar segment 12 and an end of bar segment 14. According to various embodiments, any number of additional bar segments can be similarly coupled together to create the bar assembly. In embodiments, bar segments 12, 14, and 16 can have threaded ends onto which a coupler 18, 20 can be screwed to connect two consecutive bar segments 12, 14, or 16. In other embodiments, other forms of coupling can be used. For example, in an embodiment, the alternating ends of bar segments 12, 14, and 16 can be crimped, or otherwise narrowed, such that they can be fit into a wider end of an adjacent bar segment 12, 14, or 16. In some embodiments, clamps, pins, clips, snaps, or other means of coupling adjacent bar segments 12, 14, and 16 to one another can be employed.

According to embodiments of the invention, bar segments 12, 14, and 16 (as well as any other of the various parts of the illustrative exercise apparatus 10 illustrated in FIGS. 1A and 1B) can be made of any suitable material providing structural integrity of exercise apparatus 10. In embodiments, for example, bar segments 12, 14, and 16 can be made of metal such as steel or aluminum. In other embodiments such as, for example, when an exercise apparatus 10 with a lighter overall weight is desired, materials such as nylon, graphite, polymers, carbon fiber, and the like can be used to create bar segments 12, 14, and 16 (and any other part of exercise apparatus 10). In an embodiment, for example, each of bar segments 12, 14, and 16 can be a piece of one-half-inch galvanized pipe that is eighteen inches long and threaded at both ends. In an embodiment, couplers 18 and 20 can be one-half-inch merchant steel pipe couplings.

With continued reference to FIGS. 1A and 1B, exercise apparatus 10 further includes two end segments 22 and 24 capable of being removably coupled to outside ends of bar segments 12 and 16, respectively. This coupling can be achieved in any suitable manner such as, for example, any of the ways in which adjacent bar segments can be coupled, as discussed above. In an embodiment, as illustrated in FIGS. 1A and 1B, end segments 22 and 24 can be removably coupled to bar segments 12 and 16 using end couplers 26 and 28, respectively. As illustrated, end couplers 26 and 28 can be configured to be screwed onto threaded ends of bar segment 12 and end segment 22, and bar segment 16 and end segment 24, respectively. For example, in an embodiment, couplers 26 and 28 can be one-half-inch standard steel pipe couplings.

In some embodiments, end segments 22 and 24 can be used as weights. That is, in an embodiment, an exercise apparatus 10 can be provided with a number of interchangeable end segments 22 and 24 of different weight that can, for example, be screwed onto the ends of the apparatus. In other embodiments, the exercise device can include plastic or rubber ends that can be filled with a filling material (e.g., water, sand, etc.) to vary the weight of the ends of the apparatus.

As shown in FIGS. 1A and 1B, weight assemblies 11*b* and 11*c* are attached to bar assembly 11*a* using end segments 22 and 24. For example, weights 38 and 40 can be slid onto end segments 22 and 24 and secured in place using weight locks 30 and 34, respectively. Additionally, in some embodiments, a cover 32 and 36 can be attached to an end of exercise apparatus 10. In embodiments, end segments 22 and 24 can be made of any number of materials such as, for example, metal, polymer, plastic, graphite, nylon, or the like. In an embodiment, for example, end segments 22 and 24 include four inch pieces of one-half-inch galvanized pipe that are each threaded at one end and adapted to receive, at the other end, iron weight-plates weighing any desired amount. In some embodiments, multiple plates can be removably attached to both ends of the exercise device. For example, a one-and-one-quarter pound iron plate and a two-and-one-half pound iron plate could be secured onto each end of an illustrative exercise device using thumb screw collars.

Figure 2A:
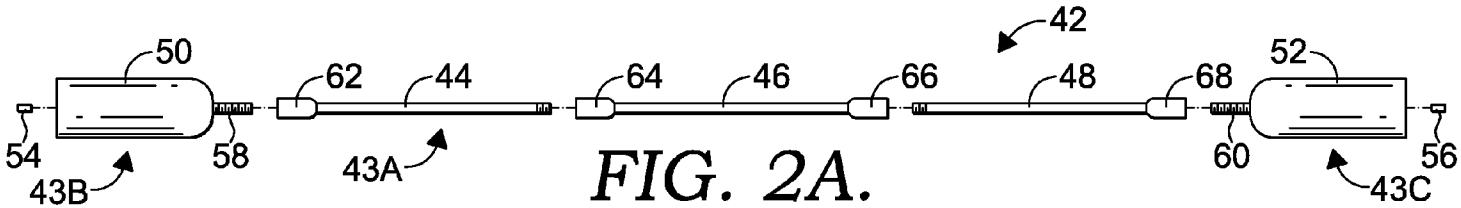
FIG. 2A is an exploded top view of an exercise apparatus in accordance with embodiments of the invention.
Figure 3A:
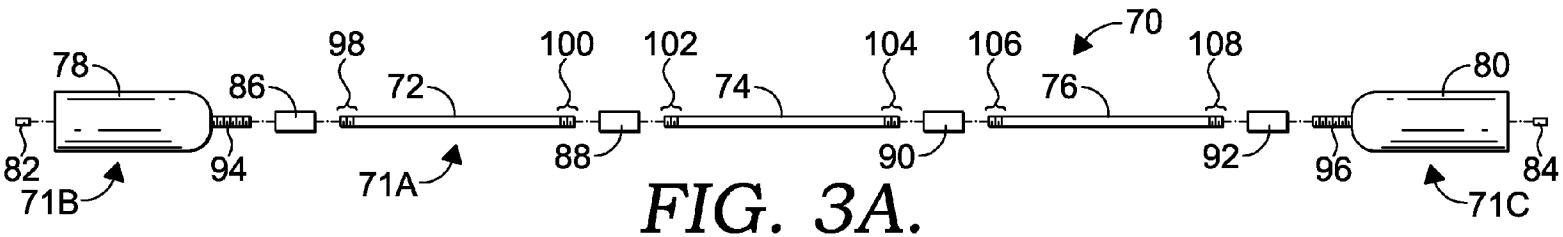
FIG. 3A is an exploded top view of an exercise apparatus in accordance with embodiments of the invention.

The illustrative exercise apparatus, in embodiments, can be assembled from its component parts such as, for example, those illustrated in FIG. 1A, FIG. 2A, or FIG. 3A. In embodiments, for example, an exercise apparatus can be assembled by joining the parts as illustrated in FIGS. 1A and 1D to create the assembled exercise apparatus illustrated in FIG. 1B (of course, similar procedures can be followed to assemble any of the various embodiments of the exercise apparatus described throughout this disclosure). The illustrative exercise apparatus depicted in the Figures and description herein is not intended to represent the only potential designs and arrangements of features. For example, in embodiments, exercise apparatus can include a single, telescoping bar segment, two bar segments, four bar segments, or any other number and/or type of bar segment. Similarly, any number of other arrangements and combinations of features are contemplated as being within the ambit of the present invention.

Turning briefly to FIG. 1C, a flow diagram depicts an illustrative method of assembling an exercise apparatus in accordance with embodiments of the invention. At a first step, step 41*a*, the component parts of the exercise apparatus are removed from their storage container (e.g., a bag, carrying case, or the like). In an embodiment, for example, the component parts can include bar segments, end segments, couplers, weights, weight reservoirs, and the like. For example, in one embodiment, a user may purchase an exercise apparatus that is included as part of a portable exercise system. For instance, in one embodiment of the invention, the portable exercise system includes a container (e.g., a canvas or nylon bag, a plastic case, etc.) containing, for example, three, eighteen-inch pieces of one-half-inch, galvanized pipe, each threaded at both ends (e.g., bar segments); two, four-inch pieces of one-half-inch, galvanized pipe, each threaded at one end (e.g., end segments); two, one-half-inch, merchant steel, pipe couplings; two, one-half-inch, standard steel, pipe couplings; two, one-and-one-quarter pound iron weight plates; two, two-and-one-half pound iron weight plates; and two thumb-screw collars. In embodiments, the exercise system can also include other items that can facilitate performing routines such as, for example, documents, recording media, timing devices, and the like.

At step 41*b*, the user assembles the bar assembly by joining the three bar segments together. In embodiments, the user joins the three bar segments by connecting a second end of a first bar segment to a first end of a second bar segment using a coupling and by connecting the second end of the second bar segment to a first end of the third bar segment using another coupling. In some embodiments, for example, the merchant steel couplings can be used to join the bar segments together. As shown at step 41*c*, the illustrative method further includes connecting an end segment onto each end of the bar assembly. In embodiments, step 41*c* can be performed, for example, by using standard steel couplings to join the end segments to the outside bar segments. For example, in an embodiment, a second end of a first end segment is coupled, using a coupling, to the first end of the first bar segment and, similarly, a first end of a second end segment is coupled to the second end of the third bar segment using a coupling.

With continued reference to FIG. 1C, at a final illustrative step, step 41*d*, weights are attached to the end segments. In embodiments, weights can include metal plates, balls, bulbs, weight reservoirs, and the like. In some embodiments, adding weights in step 41*d* can be achieved by filling cavities defined within the bar assembly with a filling material such as, for example, sand or water. In other embodiments, iron plates are attached to both ends utilizing thumb-screw collars or other fastening mechanisms to hold the weights in place.

Figure 2B:
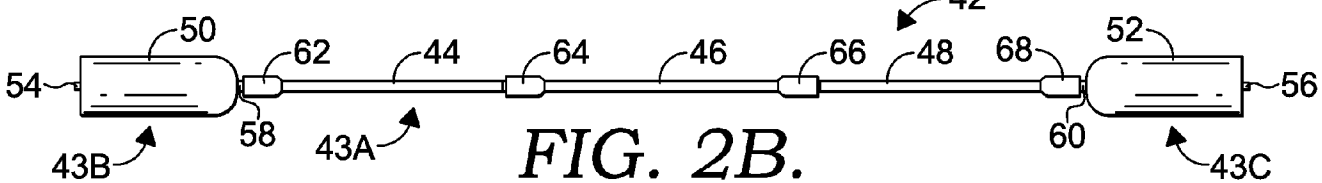
FIG. 2B is a top view of an exercise apparatus in accordance with embodiments of the invention.

Turning now to FIGS. 2A and 2B, an illustrative exercise apparatus 42 is depicted. As illustrated, exercise apparatus 42 includes bar assembly 43*a* and weight assemblies 43*b* and 43*c*. As shown, bar assembly 43*a* includes bar segments 44, 46, and 48. Bar segment 44 is coupled, at one end, to an end of bar segment 46 using coupler 64 and bar segment 46 is coupled, at the other end of bar segment 46 to bar segment 48 using coupler 66.

As shown in FIGS. 2A and 2B, weight assemblies 43*b* and 43*c* include weight reservoirs 50 and 52, respectively. In embodiments, weight reservoirs 50 and 52 can be removably attached at either end of exercise apparatus 42. For example, as shown in FIG. 2, weight reservoirs 50 and 52 can be designed to include connectors 58 and 60. In some embodiments, for example, an exercise apparatus 42 can be designed with receivers 62 and 68 that are adapted to receive a particular size or type of connector such as, for example, connectors 58 and 60. According to various embodiments, weight reservoirs 43*b* and 43*c* can be filled with a filling material to achieve a desired weight.

In embodiments, receivers 62 and 68 are integrated into the design of bar segments 44 and 48, respectively. In some embodiments of the invention, for example, bar segments 44 and 48 and receivers 62 and 68 can be a single, continuous, part. In other embodiments, receivers 62 and 68 can be fixed to bar segments 44 and 48. In various additional embodiments, receivers 62 and 68 can be integrated within bar segments 44 and 48 such that connectors 58 and 60 are inserted into the open ends of bar segments 44 and 48, respectively. Upon insertion, some mechanism can be employed to secure weight assemblies 50 and 52 to bar segments 44 and 48, respectively.

According to some implementations of embodiments of the invention, weight reservoirs can be common and accessible reservoirs such as, for example, soda bottles (which typically have a connector 58 and 60 that is the neck of the soda bottle having the spiral plane upon which a screw-top cap is affixed). In other embodiments, weight reservoirs 50 and 52 can include metal bottles, plastic bottles, bags, specially-designed reservoirs, and the like. According to further embodiments, bar assembly 43*a* can include internal weight assemblies 43*b* and 43*c*. For example, a portion of each of bar segments 44 and 48 can be hollow and sealed so as to allow the portion to be filled with a filling material. In such an implementation, a cap, plug or other means of securing the filling material within the bar assembly 43*a* can be employed.

In embodiments, weight reservoirs 50 and 52 can be configured to be filled with a filling material such as, for example, sand, water, or some other liquid or solid material. In embodiments, filling material for reservoirs 50 and 52 can be selected based on the material's density so that a desired weight can be achieved, for example. As illustrated, weight reservoirs 50 and 52 can include plugs 54 and 56 that can be removably fitted into openings (not illustrated) in weight reservoirs 50 and 52. In embodiments, weight reservoirs 50 and 52 can be filled with filling material by way of the openings, whereby the plugs 54 and 56 can be inserted such that the filling material cannot escape weight reservoirs 50 and 52.

For example, in an embodiment, an illustrative exercise apparatus has a fully-assembled length of seventy-eight inches, or approximately the same, and is assembled from a bar assembly that includes an eighteen-inch shaft and a three-inch coupler integrated onto each end that is adapted to receive a threaded end of a twenty-one inch end segment. In an embodiment, the end segments each include a coupling structure for receiving a three-inch connector that is fixed on one end of a twelve-inch weight reservoir having a one-inch plug. In embodiments, for example, the weight reservoir can have a capacity of any desired amount (e.g., 24 fluid ounces, 64 fluid ounces, etc.) that can be filled with a liquid such as water (or, in other embodiments, with a solid material such as sand) to provide variably-weighted ends to the apparatus. In some embodiments, the plug can fill an opening on the bottom (far outside edge) of a weight reservoir, or on any other portion of the reservoir. In some embodiments, the bar assembly can be adapted to weigh two pounds or less. In other embodiments, such as where the bar assembly is metal and the weight assemblies are plates (and not, e.g., fluid reservoirs), the bar assembly can be adapted to weigh approximately twelve pounds. In some embodiments, weight assemblies can be adapted to be five pounds or less. Additional embodiments contemplate various types of technology for connecting components of the bar assembly, for example. In embodiments, locking devices that may lock two pieces together in response to one of the pieces being turned, for example, a quarter of a turn, can be employed in embodiments of the invention.

Figure 3B:
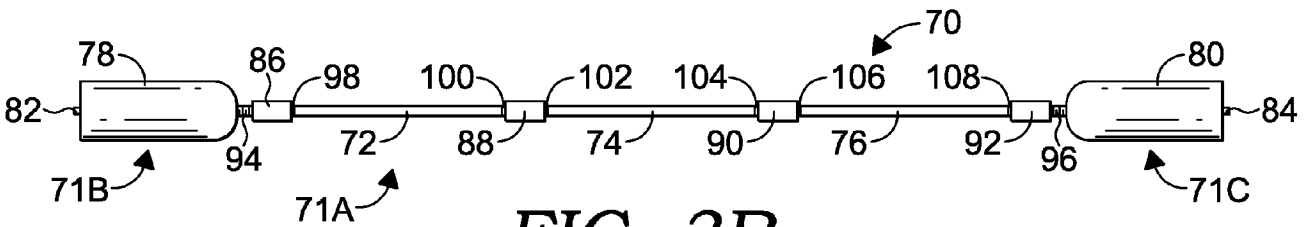
FIG. 3B is a top view of an exercise apparatus in accordance with embodiments of the invention.

Turning now to FIGS. 3A and 3B, an illustrative exercise apparatus 70 is depicted in accordance with embodiments of the invention. Exercise apparatus 70 includes bar assembly 71*a* and weight assemblies 71*b* and 71*c*. As shown, bar assembly 71*a* includes bar segments 72, 74, and 76, which can be coupled in series using couplers 88 and 90. Weight assemblies 71*b* and 71*c* include weight reservoirs 78 and 80, respectively, that can be removably coupled to either end of exercise apparatus 70 using couplers 86 and 92, respectively. As shown in FIGS. 3A and 3B, each bar segment 72, 74, and 76 includes threaded ends 98 and 100, 102 and 104, and 106 and 108, respectively, onto which couplers 86, 90, and 92 can be screwed.

Various illustrative examples of an exercise apparatus have been described above in accordance with embodiments of the invention. According to embodiments, the invention includes an apparatus and a method of using the apparatus. For example, illustrative embodiments of the exercise apparatus described above can be utilized to perform methods corresponding, for example, to workout routines, exercises, stretches, and the like. In embodiments, the invention combines low-impact stretching, cardiovascular and light weight exercise into twenty to thirty minute workouts that utilize a single, transportable piece of equipment.

Turning now to FIGS. 4A-4C, 5A-5C, 7A-7E, and 8, exemplary methods of using an exercise apparatus in accordance with embodiments of the invention are depicted in a series of illustrations of a user 202 utilizing an exercise apparatus 204 to perform routines. Throughout the document, a "routine" refers to a series of steps, a method, a process, or the like. In embodiments, performing a routine can include performing the series of steps, utilizing the exercise apparatus 204, from a first step to a last step. In some embodiments, various steps (including the first and last steps) can be omitted, repeated, modified, and the like. Additionally, in embodiments of the invention, steps from different routines can be intermingled, substituted, rearranged (e.g., performed in various different sequences), and the like. All of such embodiments are considered to be within the ambit of the invention.

Figure 4C:
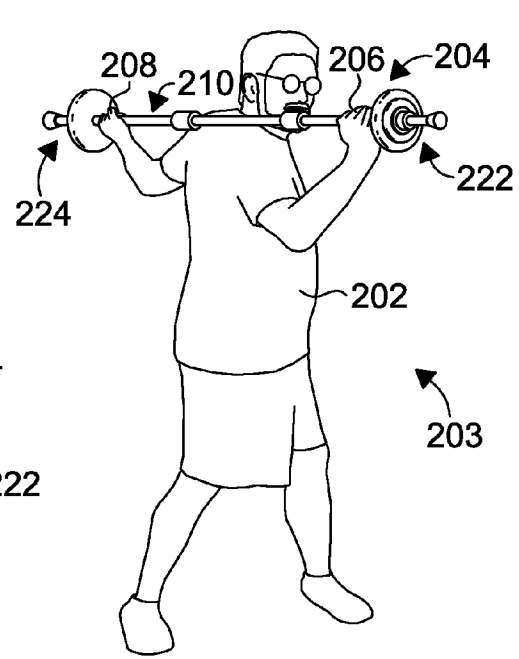
FIGS. 4A-4C depict a user performing a routine using an exercise apparatus in accordance with embodiments of the invention.
Figure 4B:
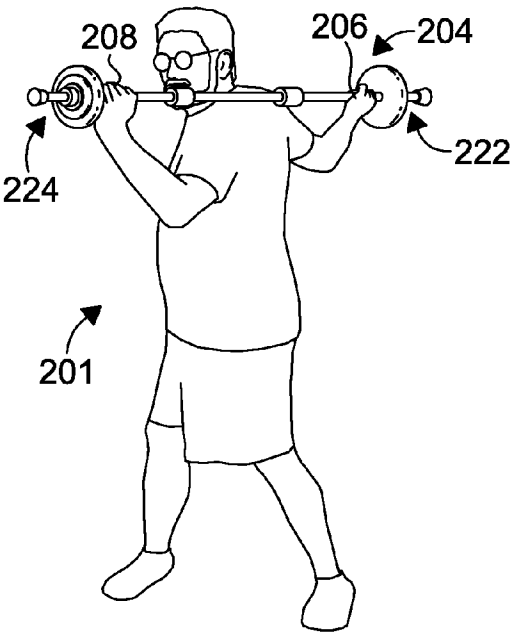
Figure 4A:
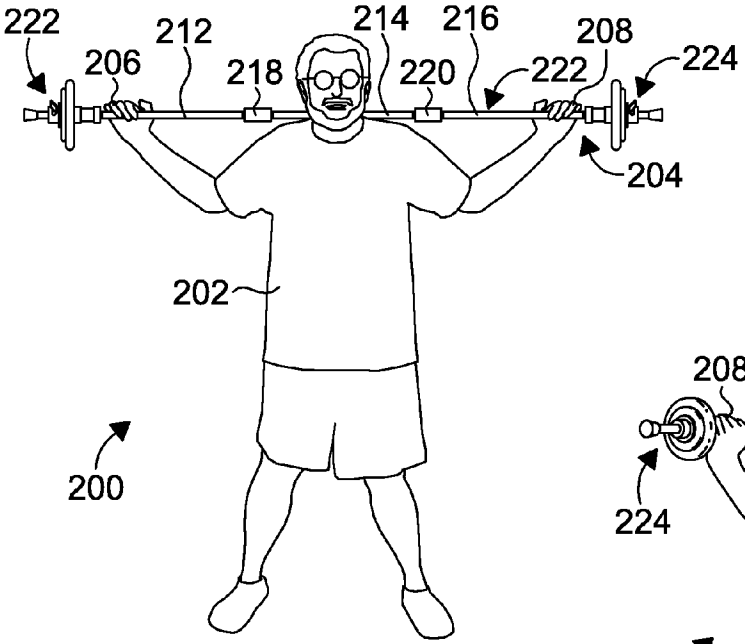

Turning now to FIGS. 4A-4C, an illustrative basic twist exercise routine, using an exemplary exercise apparatus 204, is depicted. As illustrated, an initial position 200 is depicted in FIG. 4A. In the initial position 200, a user 202 places the exercise apparatus 204 over the user's 202 shoulders with arms extended comfortably out and hands 206 and 208 gripping the bar assembly 222. Weight assemblies 222 and 224 can be adjusted to include any desired amount of weight. In embodiments, the user places the user's hands 206 and 208 on the bar segments 212 and 216, respectively, so that the middle bar segment 214 is oriented behind the user's head. As shown in FIGS. 4B and 4C, in operation, the user 202 swings the apparatus 202 from side to side by twisting the user's 202 midriff area, allowing the momentum of the weight assemblies to stretch the user's 202 muscles and the like. As illustrated, a second position 201 is achieved when the user 200 swings fully to the user's 202 right side and a third position 203 is achieved when the user 202 swings fully to the user's 202 left side.

Figure 5C:
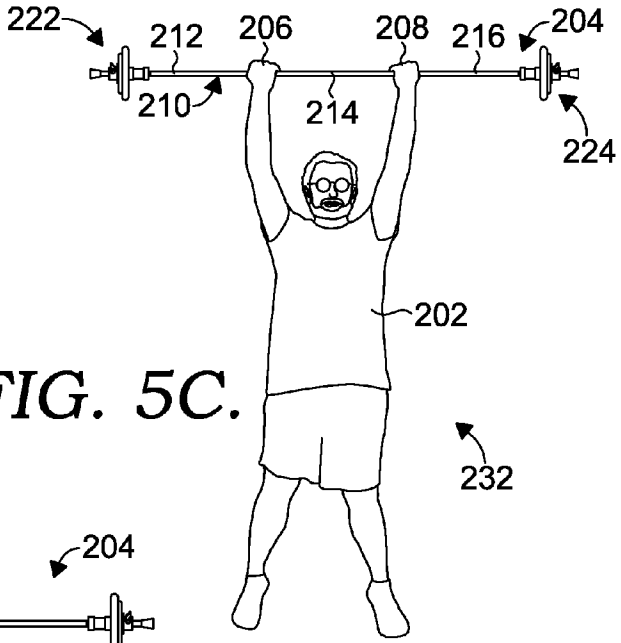
FIGS. 5A-5C depict a user performing another routine using an exercise apparatus in accordance with embodiments of the invention.
Figure 5B:
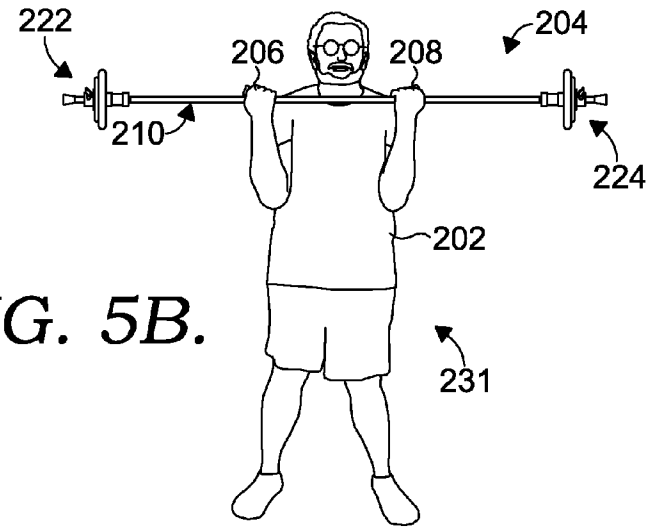
Figure 5A:
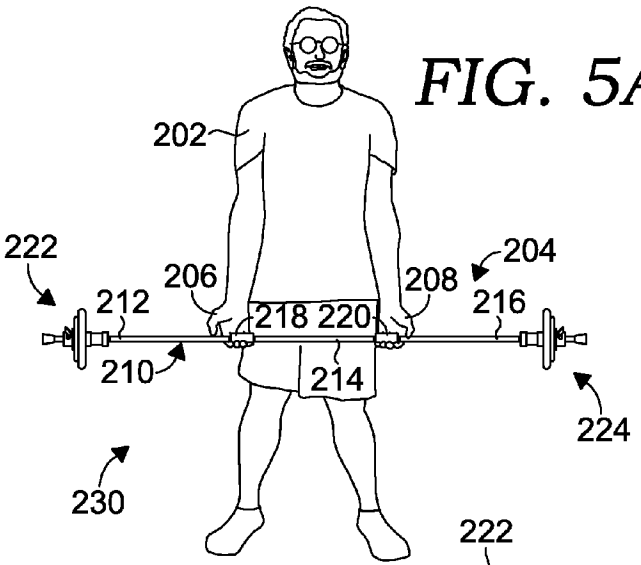

Turning now to FIGS. 5A-5C, an illustrative curl and overhead momentum exercise routine is depicted. As shown in FIG. 5A, in a first position 230, the user 202 grips the exercise apparatus 204 palms up and toward the middle of the bar assembly 224, with hands apart (e.g., between six and eight inches apart). In embodiments, the user 202 grips the bar assembly 204 at couplers 218 and 220, while in other embodiments, the user 202 grips the bar assembly 204 to one side or the other of each coupler 218 and 220. In operation, the user 202 extends the user's 202 arms straight down, then curls the apparatus 204 up to chest level, as indicated by a second position 231, depicted in FIG. 5B, and in a single motion, the user 202 lifts the apparatus 204 straight up, straightening the user's 202 arms overhead, as indicated by a third position 233, depicted in FIG. 5C. In embodiments, the user 202 can raise up onto the user's 202 toes while moving the apparatus 204 into the third position 233. In embodiments, the routine depicted in FIGS. 5A-5C is completed by moving the apparatus 204 back down into the first position 230.

Figure 6B:
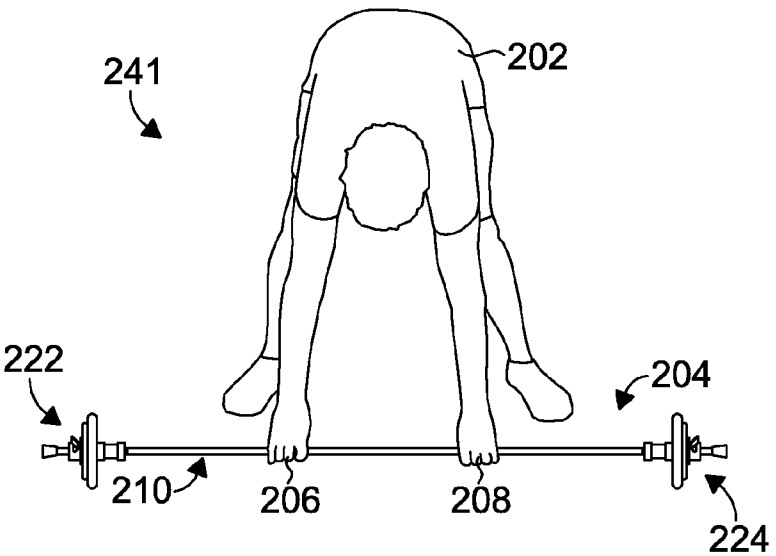
FIGS. 6A-6B depict a user performing another routine using an exercise apparatus in accordance with embodiments of the invention.
Figure 6A:
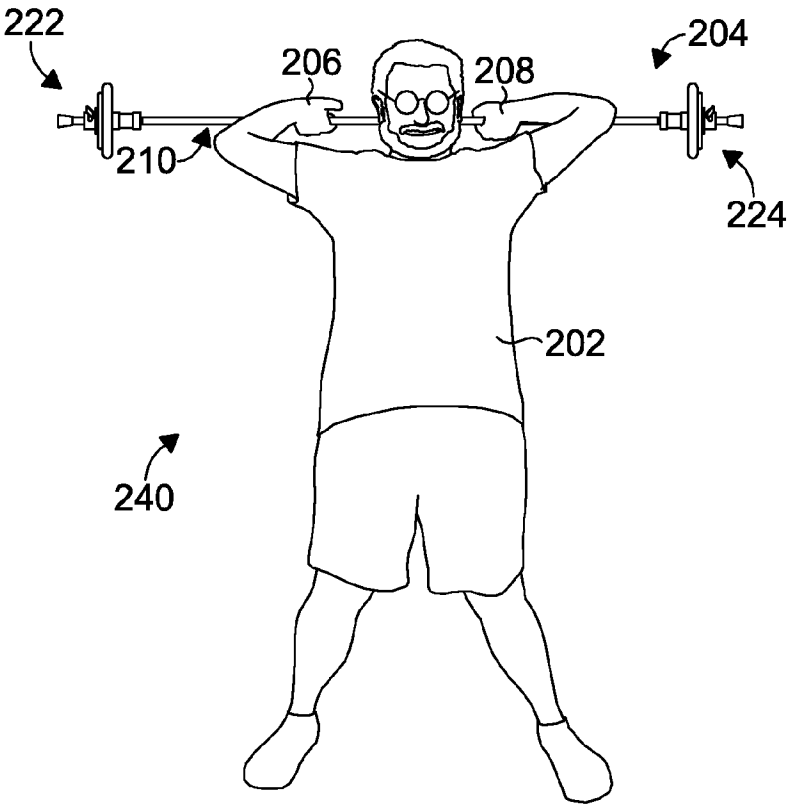

Turning now to FIGS. 6A and 6B, an illustrative forward bend routine is depicted. As illustrated in FIG. 6A, the user 202 begins the routine by gripping the bar assembly 210, palms down and near the middle of the bar assembly 210, with hands being placed between six and eight inches apart. In operation, the user 202 brings the apparatus up and over the user's 202 head, moving the apparatus 204 back as far as is comfortable, to define a first position 240. In one motion, the user 202 moves the apparatus 204 back to the midriff position and then bends forward, keeping the user's 202 knees locked or as straight as possible, until a second position 241 is achieved.

Figure 7A:
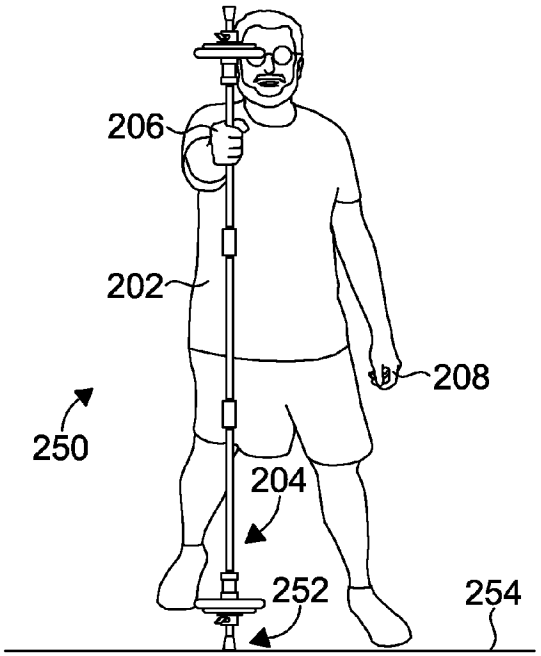
FIGS. 7A-7E depict a user performing another routine using an exercise apparatus in accordance with embodiments of the invention.
Figure 7B:
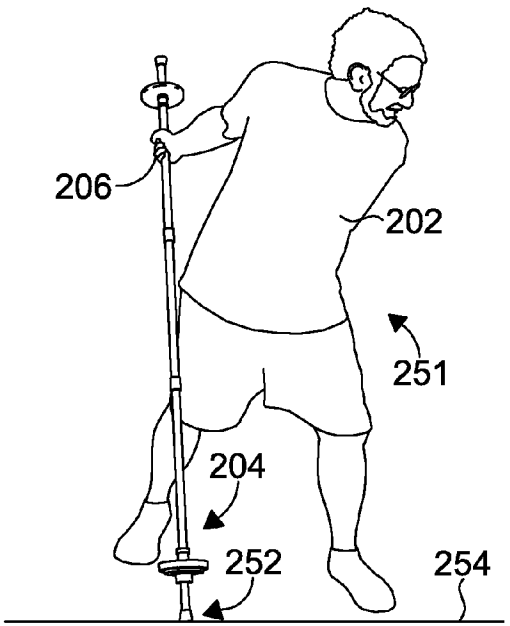
Figure 7C:
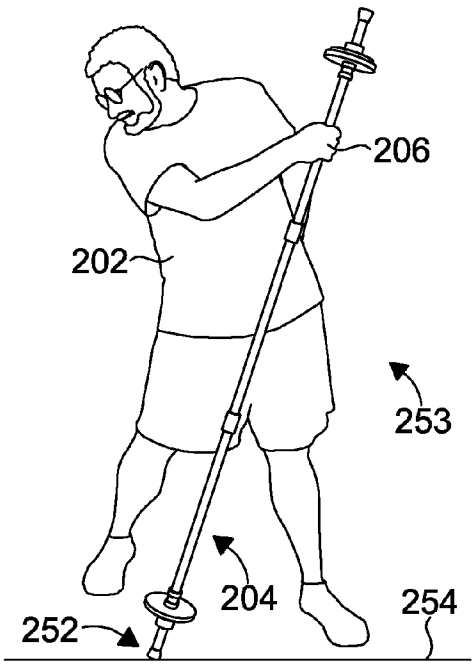
Figure 7E:
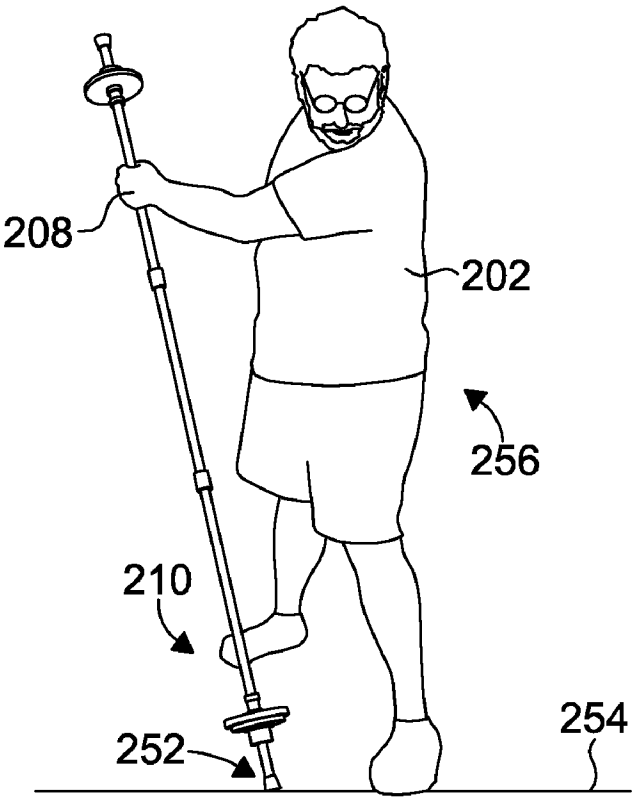
Figure 7D:
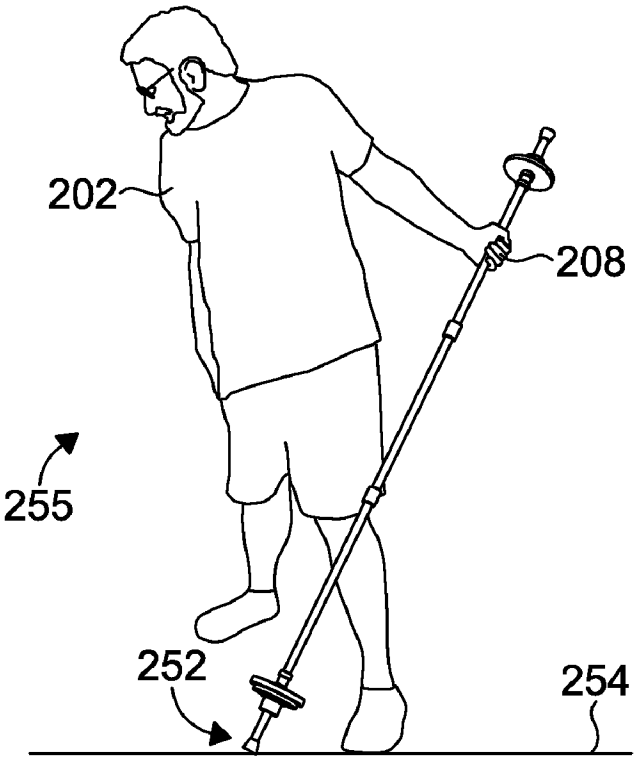

Turning now to FIGS. 7A-7C, an illustrative neck extension routine is depicted. As illustrated in FIG. 7A, in a first position 250, the user 202 places one end 252 of an exemplary exercise apparatus 204 on the ground 254 in front of the user 202. In an embodiment, the bag in which the disassembled apparatus can be stored and transported can be disposed between the apparatus 204 and the ground 254. According to embodiments, the first position 250 of the illustrative routine includes gripping the apparatus 204 with one hand 206, at chest level. As indicated in FIG. 7B, a second position 251 is achieved by the user 202 swinging the apparatus 204 out to the side of the gripping hand 206. As illustrated in FIG. 7B, in embodiments, the user 202 can simultaneously turn the user's 202 head in the opposite direction. To achieve a third position 253, the user 202 brings the apparatus 204 back toward the user's 202 midriff area, allowing momentum to carry the apparatus 204 in the opposite direction (e.g., as far as possible). In embodiments, the exercise routine depicted in FIGS. 7A-7C can be repeated with the other hand 208, as depicted in the first 260 and second 261 positions of an illustrative routine in FIGS. 7D and 7E.

Figure 8:
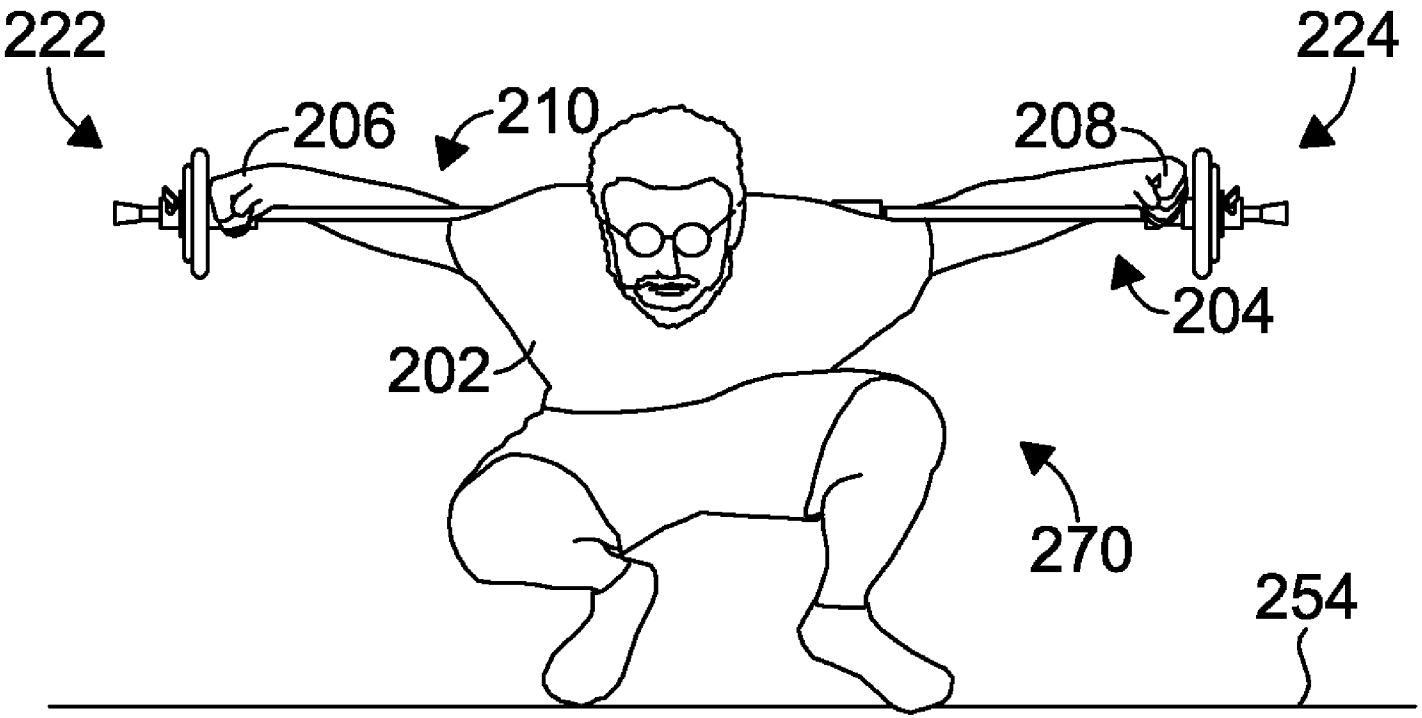
FIG. 8 depicts a user performing another routine using an exercise apparatus in accordance with embodiments of the invention.

Turning, now, to FIG. 8, an illustrative squat routine is depicted by an illustration of a squat position 270. As depicted in FIG. 8, the user 202 achieves the squat position 270 by placing the apparatus 204 across the shoulders and squatting down as far as is comfortable. In embodiments, the user 202 holds such a position 270 for fifteen to thirty seconds. In other embodiments of the invention, squat routines (not illustrated) can include, for example, the user placing one end of the bar on the ground in front of the user and squatting down as far as is comfortable, using the apparatus for stability and to help up straighten up. In embodiments, the user holds such a position for fifteen to thirty seconds. In some embodiments of the invention, exercise programs (i.e., sets of exercise routines) can include one to two minutes allotted for performing squats. In other embodiments, exercise programs can be configured for any amount of any particular exercise routine.

Figure 9:
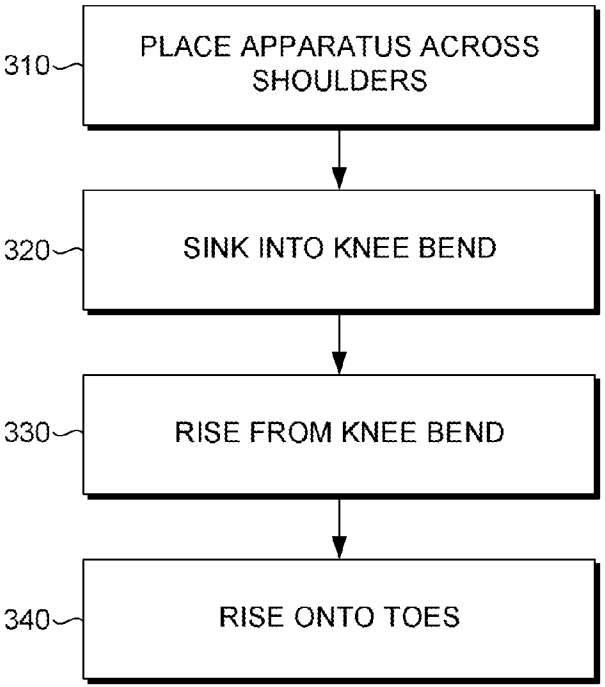
FIG. 9 is a flow diagram depicting an illustrative method of performing a routine that utilizes an exercise apparatus in accordance with embodiments of the invention.

Additional embodiments of the invention include various other types of exercise routines that can be performed using an exercise apparatus consistent with an embodiment of the invention. For example, as illustrated by the flow diagram in FIG. 9, an illustrative routine can include knee bends, in which, at step 310 a user places the apparatus across the shoulders with the user's arms extended comfortably out and hands gripping the bar assembly. In embodiments, as shown at step 320, while keeping the user's back erect, the user can sink into a knee bend, squatting down as far as is comfortable. At step 330, the user rises again, and, as shown at step 340, as the user rises, the user rises up onto the user's toes.

Figure 10:
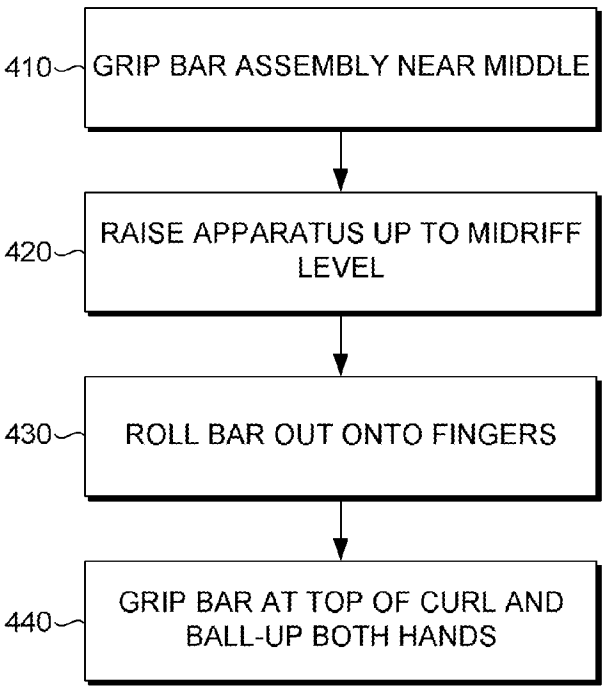
FIG. 10 is a flow diagram depicting another illustrative method of performing a routine that utilizes an exercise apparatus in accordance with embodiments of the invention.

In other embodiments, routines can include arm curls. Turning to FIG. 10, a flow diagram depicts an illustrative method of performing a routine for arm curls. At step 410, the user grips the bar assembly near the middle, with palms facing up and hands, for example, six to eight inches apart. At step 420, the user raises the apparatus up to the user's midriff level, and, while doings so, the user rolls the bar out onto the users fingers to stretch them out, as indicated at step 430. At the top of the curl, the user can grip the bar, balling up both hands, as indicated at step 440. In some embodiments, the user can perform toe raises simultaneously such as, for example, at the top of the curl.

Figure 11:
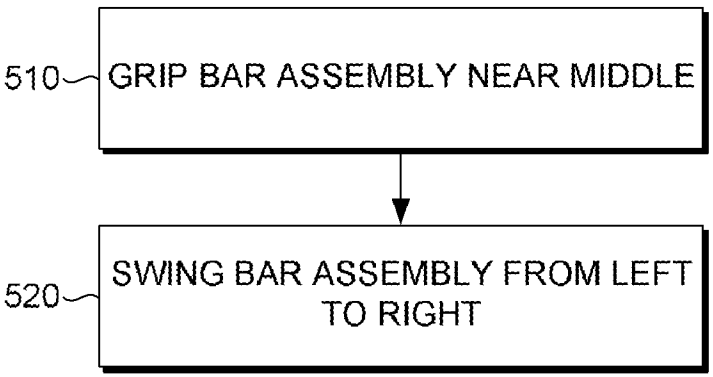
FIG. 11 is a flow diagram depicting another illustrative method of performing a routine that utilizes an exercise apparatus in accordance with embodiments of the invention.

In embodiments, other routines can include, for example, a front twist, as depicted by the flow diagram in FIG. 11. According to embodiments of the illustrative method of performing a front twist routine, the user grips the bar assembly in the middle, with palms down (e.g., approximately six to eight inches apart), as shown at step 510. At step 520, the user swings the apparatus from left to right, allowing momentum to bring the arms naturally up and down.

Figure 12:
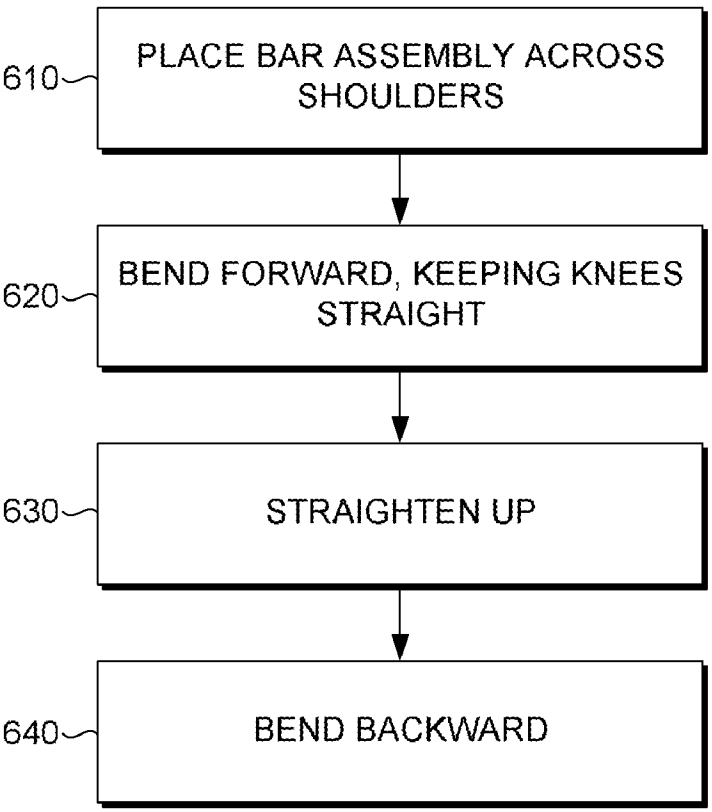
FIG. 12 is a flow diagram depicting another illustrative method of performing a routine that utilizes an exercise apparatus in accordance with embodiments of the invention.

According to embodiments, static stretching exercises can be done, for example, before or after working out to warm up, to cool down or both. Such exercises can be characterized by routines that include, for example, torso stretches. FIG. 12 is a flow diagram that depicts an illustrative method of performing a routine for stretching the user's torso. At step 610, the user places the bar assembly across the user's shoulders and, as shown at step 620, bends forward, keeping the user's knees straight. At step 630, the user straightens up and, at step 640, bends backwards as far as is comfortable. Additionally, in some embodiments, the user can bend at the waist to the left, straighten up, and bend to the right as far as is comfortable. In embodiments, for example, these bent positions can be held for five to ten seconds, and the routine repeated for one or two minutes. As with any of the other positions, movements, and the like described herein, the user can hold such positions for any desired duration of time.

Figure 13:
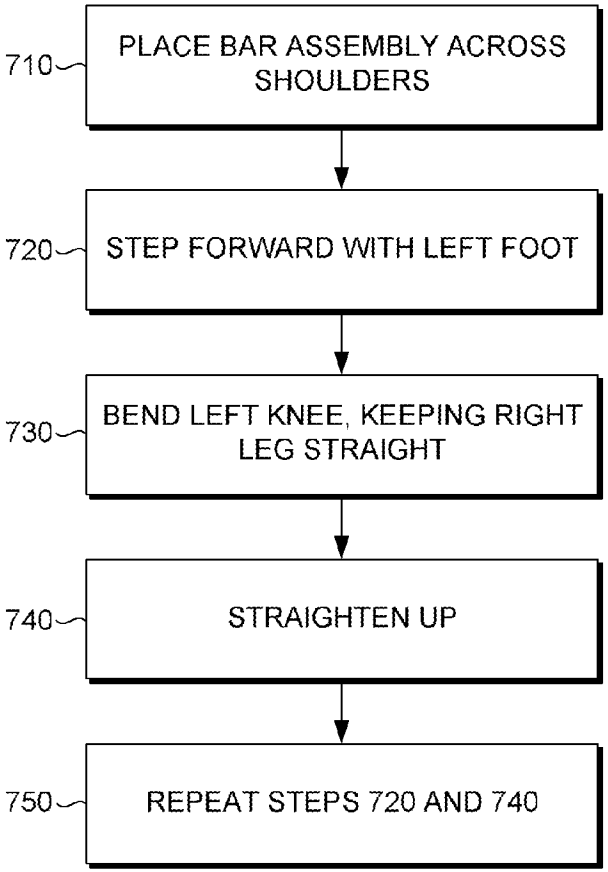
FIG. 13 is a flow diagram depicting another illustrative method of performing a routine that utilizes an exercise apparatus in accordance with embodiments of the invention.

According to some embodiments of the invention, an exercise apparatus such as those described herein can be utilized to perform additional routines, as well. Such routines can include, for example, leg stretches, elbow extensions, and shoulder stretches, any of which may, in embodiments, be performed for one or two minutes each (e.g., when included as a part of an exercise program). For example, an illustrative method of performing a leg stretch routine is depicted in a flow chart in FIG. 13. As illustrated, to perform a leg stretch routine, at step 710, a user places the apparatus across the user's shoulders. At step 720, the user steps forward with the user's left foot and, as indicated at step 730, the user bends the left knee while keeping the right leg straight. At step 740, the user straightens up and, as shown at step 750, the user repeats the steps 720 and 740, bringing forward the right foot. In embodiments, the positions may be held for five to ten seconds, giving the user an opportunity to feel the weight of the apparatus.

Figure 14:
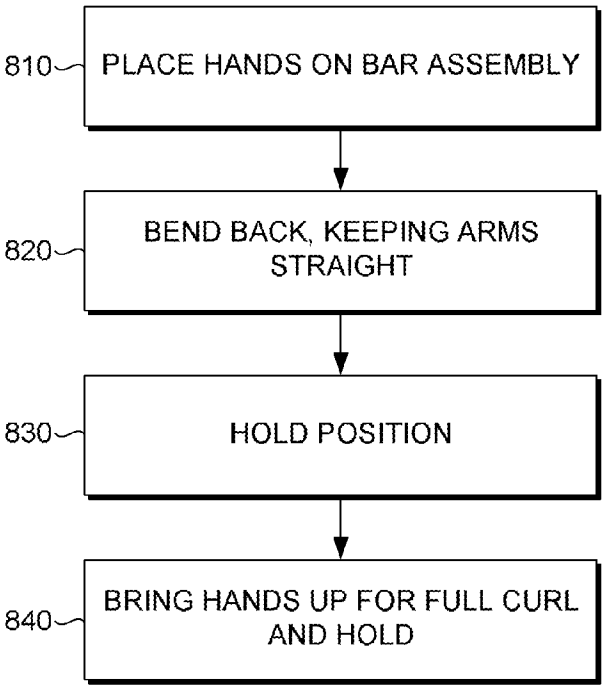
FIG. 14 is a flow diagram depicting another illustrative method of performing a routine that utilizes an exercise apparatus in accordance with embodiments of the invention.

Turning to FIG. 14, a flow diagram depicts an illustrative method of performing an elbow extension routine in accordance with embodiments of the invention. As shown at step 810, embodiments of the illustrative method can be performed by the user by positioning the user's hands on the bar assembly, palms up, between approximately sixteen and twenty-four inches apart. At step 820, the user bends back as far as is comfortable, keeping the user's arms straight, allowing the weight of the apparatus to extend the user's elbows. According to some embodiments, as indicated at step 830, the user can hold this position for four or five seconds and then, at step 840, the user brings the user's hands up while holding this full curl position another four to five seconds.

Figure 15:
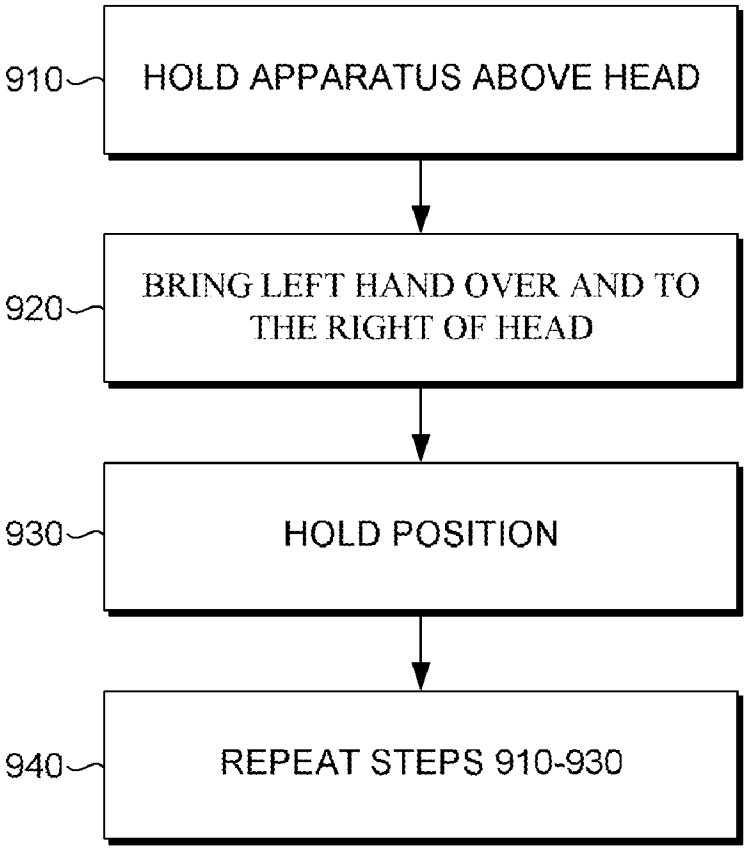
FIG. 15 is a flow diagram depicting another illustrative method of performing a routine that utilizes an exercise apparatus in accordance with embodiments of the invention.

In further embodiments, a user can perform shoulder stretch routines, for example, using an embodiment of the illustrative method depicted by the flow diagram in FIG. 15. As indicated at step 910, the user holds the apparatus with the user's arms extended above the user's head. In embodiments, the user's hands can be positioned, for example, between approximately sixteen and twenty-four inches apart with the user's palms facing front wards. Without bending the torso, the user can bring the left hand over and a little to the right of the top of the user's head, as shown at step 920. In embodiments, at step 930, the user holds this position for four or five seconds, which can, in embodiments, allow the user to feel the weight of the apparatus in the user's shoulders. In embodiments, as shown at step 940, the user can repeat this exercise, bringing the user's right hand up and over the user's head.

Basic exercises can, according to exercise programs established in accordance with embodiments of the invention, be done three to five times each week. In some embodiments, the exercises can be done fewer times in a week, and in other embodiments, the exercises could be done more than five times each week. According to various embodiments, the exercises, exercise programs, and the like can be timed. Any suitable method of timing can be used such as, for example, utilizing a timing device such as, for example, a kitchen timer, a clock, or the like. In some embodiments, an exercise program can, for example, designate specific workouts. Workouts, as used herein, are exercise sessions characterized by a user performing a number of exercise routines in succession. A workout program can designate amounts of time for which each routine is to be performed, the number of repetitions of a routine that are to be performed, the order in which routines are to be performed, and the like.

Figure 16:
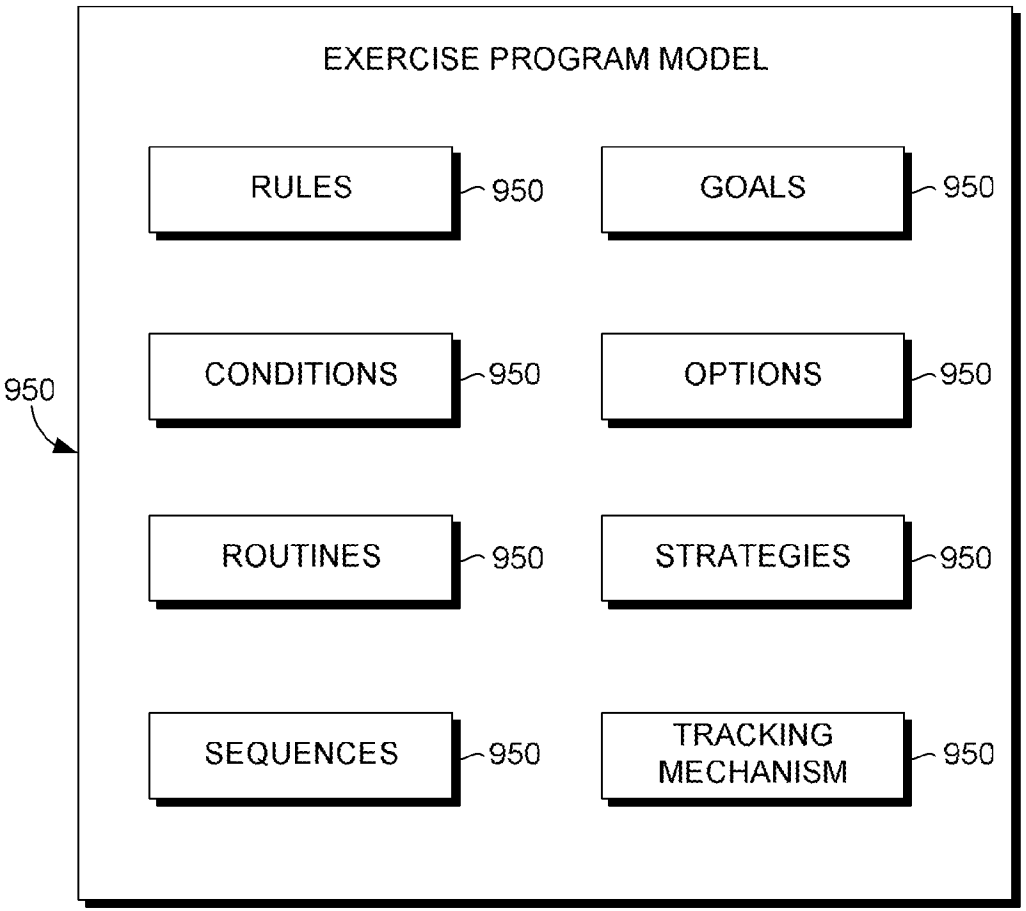
FIG. 16 depicts an illustrative exercise program model in accordance with embodiments of the invention.

In some embodiments, as illustrated in FIG. 16, an exercise program can be represented by a model 950. In embodiments, the model 950 can include a document, a chart, a list, a brochure, an application, an application plug-in, a computer file, a database, a spreadsheet, or the like. Model 950 represents an exercise program and includes, according to various embodiments of the invention, components such as rules 952, conditions 954, exercise routines 956, indications 958 of sequences in which routines 956 are to be performed, goals 960, options 962, strategies 964, and a mechanism 966 for collecting data to enable the user to keep track of the user's progress through the workout program.

For example, in one embodiment, an exercise program can specify that in the beginning, each routine 914 should be performed for no more than one minute. In some embodiments, rules 910 can specify discomfort levels that are to trigger changes to the program, based upon the user's observance of the discomfort levels. For example, in an embodiment, an exercise program can designate that exercises should cause no more discomfort than that which two aspirins can relieve.

In an embodiment, the exercise program can further indicate rules 910 and conditions 912 for advancing through the program such as, for example, a rule 910 that states that, after exercise coordination is mastered and discomfort is no longer felt, the duration of each exercise routine is to be extended to two minutes. In embodiments, exercise programs can indicate goals 918. For example, a goal 918 established in an exercise program can be to perform each exercise routine for three to four minutes each, for a total exercise period of 15 to 20 minutes. As the terms are used herein, exercising for fifteen minutes is considered a 'complete' workout, while a routine having a duration of twenty minutes or more is referred to as a 'full' workout.

According to embodiments, exercise programs can include any number of static or dynamic strategies 922. In an embodiment, an exercise program can include a number of predetermined strategies 922 (e.g., static strategies) from which a user can choose based, for example, on the user's body-type, level of health, personal goals, or the like. In an embodiment, for example, a strategy can be dynamically updated based on data collected regarding the user's progress through the exercise program. To illustrate the concept of the exercise program strategy, an exercise program might, for example, include the following strategy:

During beginning workouts, no weight should be placed on the ends of the apparatus, allowing the weight of the arms and the basic apparatus to generate stretching momentum. Once a discomfort free, full workout is achieved, the one-and-one-quarter pound plates should be added to the ends of the apparatus. When additional weight is added, each exercise should be cut back to one or two minutes. When a discomfort free, full workout is achieved, the two-and-one-half pound weights should be substituted. The ultimate goal is to do a discomfort free, full workout consisting of five exercises, for four minutes apiece, with weights on both ends of the apparatus.

According to various embodiments of the invention, exercise programs can make use of a recording medium having a recording embodied thereon such as, for example, an audio CD provided with the exercise apparatus. In an embodiment, the CD can be played before, during, and/or after workouts. In embodiments, the CD can include music that is selected and provided to be played in conjunction with performing certain types of routines and the like. In embodiments, the CD can include instructional information. Similarly, in some embodiments, a DVD can be provided that includes instructional video, music videos, and the like.

In an embodiment, for example, an exercise program includes a set of three workouts to be performed using an exercise apparatus in accordance with implementations of the invention. In an embodiment, a CD is included with the exercise apparatus that includes three, twenty-minute recordings that will help move a user through the following, progressive routines. In embodiments, of course, the CD could include any number of workouts, recordings, and the like. In some embodiments, each recording is followed by ten minutes of silence in which, for example, static, cool-down stretching can be done to finish the exercise period. In embodiments, each of the workouts utilizes the same exercise routines.

For example, in an embodiment, a workout program can specify that each of three workouts utilizes the same five basic exercises routines: basic twist; curl and overhead momentum; forward bend; knee bends; and neck extensions. A first workout can be utilized to increase awareness of the body while engaged in the five basic exercises routines. The first CD recording, for example, can be an audible twenty-minute ("Tick-Tock") countdown. In embodiments, a second workout can include a twenty-minute recording that includes music with a strong beat and constant rhythm. In embodiments, for example, a third workout can be set to a twenty-minute recording of natural sounds that fade in and out to indicate the beginnings and endings of the basic exercises routines. In various embodiments, an exercise program can specify any number of different types of exercise routines, sequences of routines, types of accompanying audio recordings, and the like.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

The invention claimed is:

1. An exercise apparatus, comprising:

a bar assembly comprising a first bar segment and a second bar segment, each of the first and second bar segments having a first threaded end and a second threaded end, wherein the second threaded end of the first bar segment is removably coupled with the first threaded end of the second bar segment using a first coupler that is screwed onto the second threaded end of the first bar segment and the first threaded end of the second bar segment, and further comprising a third bar segment having a first threaded end and a second threaded end, wherein the first threaded end of the third bar segment is removably coupled with the second threaded end of the second bar segment using a second coupler that is screwed onto the first threaded end of the third bar segment and the second threaded end of the second bar segment;

a first end segment having a first end and a second end, wherein the first end segment is removably coupled, at the second end of the first end segment, to the first end of the first bar segment, and wherein the first end segment is shorter in length than each of the first, second, and third bar segments;

a second end segment having a first end and a second end, wherein the second end segment is removably coupled, at the first end of the second end segment, to the second end of the third bar segment, and wherein the second end segment is shorter in length than each of the first, second, and third bar segments;

a first weight assembly that is removably coupled to the first end of the first end segment; and a second weight assembly that is removably coupled to the second end of the second end segment.

2. The apparatus of claim 1, wherein the first weight assembly includes a weight-plate removably attached to the first end segment.

3. The apparatus of claim 2, wherein the weight-plate is held in place by a thumb screw collar.

4. The apparatus of claim 1, wherein the bar segments include steel pipe.

5. The apparatus of claim 1, wherein each of the bar segments is made of at least one of nylon, graphite, and carbon fiber.

6. The apparatus of claim 1, wherein the second end of the first bar segment is coupled with the first end of the second bar segment using a standard steel pipe coupling.

7. A portable exercise system comprising:

a set of parts of an exercise apparatus, the exercise apparatus comprising:

(1) a bar assembly comprising a first bar segment and a second bar segment, each of the first and second bar segments having a first and second end, wherein the second end of the first bar segment is removably coupled with the first end of the second bar segment;

(2) a first weight assembly that is removably coupled to a first end of the bar assembly; and (3) a second weight assembly that is removably coupled to a second end of the bar assembly;

a recording medium having a recording embodied thereon; and a portable container that holds the set of parts and the recording medium, wherein the portable container is a canvas bag, wherein the recording corresponds to an exercise program, the exercise program comprising three workouts, wherein each workout includes an exercise session during which a user performs five exercise routines, and wherein the recording includes three, twenty-minute recordings, each recording corresponding to a workout.

8. The system of claim 7, further comprising a timing device.

9. The system of claim 7, the bar assembly further comprising a third bar segment having a first end and a second end, wherein the first end of the third bar segment is removably coupled with the second end of the second bar segment.

10. The system of claim 9, the bar assembly further comprising:

a first end segment having a first end and a second end, wherein the first end segment is removably coupled, at the second end of the first end segment, to the first end of the first bar segment; and a second end segment having a first end and a second end, wherein the second end segment is removably coupled, at the first end of the second end segment, to the second end of the third bar segment.

11. An exercise apparatus, comprising:

a bar assembly comprising a first bar segment, a second bar segment, and a third bar segment, wherein each of the first, second, and third bar segments includes a first threaded end and a second threaded end, wherein the second threaded end of the first bar segment is removably coupled with the first threaded end of the second bar segment using a first pipe coupling that is screwed onto the second threaded end of the first bar segment and the first threaded end of the second bar segment, and wherein the second threaded end of the second bar segment is removably coupled with the first threaded end of the third bar segment using a second pipe coupling that is screwed onto the second threaded end of the second bar segment and the first threaded end of the third bar segment, and wherein each of the first, second, and third bar segments is a piece of galvanized steel pipe having a length of eighteen inches;

a first end segment having a first end that is adapted to receive a first weight assembly, and having a second end that is threaded, wherein the first end segment is removably coupled, at the second end of the first end segment, to the first threaded end of the first bar segment using a third pipe coupling that is screwed onto the second end of the first end segment and the first threaded end of the first bar segment, and wherein the first end segment is a piece of galvanized steel pipe having a length of four inches; and a second end segment having a first end that is threaded and a second end that is adapted to receive a second weight assembly, wherein the second end segment is removably coupled, at the first end of the second end segment, to the second threaded end of the third bar segment using a fourth pipe coupling that is screwed onto the first end of the second end segment and the second threaded end of the third bar segment, and wherein the second end segment is a piece of galvanized steel pipe having a length of four inches;

wherein the first weight assembly is removably coupled to the first end of the first end segment, and wherein the first weight assembly includes a first iron weight plate having a weight of one-and-one-quarter pounds and a second iron weight plate having a weight of two-and-one-half pounds; and wherein the second weight assembly is removably coupled to the second end of the second end segment, and wherein the second weight assembly includes a third iron weight plate having a weight of one-and-one-quarter pounds and a fourth iron weight plate having a weight of two-and-one-half pounds.

* * * * *